US006454371B1

(12) United States Patent
Müterthies et al.

(10) Patent No.: US 6,454,371 B1
(45) Date of Patent: Sep. 24, 2002

(54) PULL-OUT SLIDE SET

(75) Inventors: Ralf Müterthies, Löhne (DE); Stefan Rüter, Bad Oeynhausen (DE); Carsten Meyer, Bielefeld (DE); Gerhard Schröder, Bad Oeynhausen (DE); Jörg Aufderheide, Spenge (DE)

(73) Assignee: Paul Hetttich GmbH & Co., Kirchlengren (DE)

( * ) Notice: Subject to any disclaimer, the term of this patent is extended or adjusted under 35 U.S.C. 154(b) by 175 days.

(21) Appl. No.: 09/663,189

(22) Filed: Sep. 15, 2000

(30) Foreign Application Priority Data

Sep. 17, 1999 (DE) ..... 199 44 640

(51) Int. Cl.[7] ..... A47B 88/02
(52) U.S. Cl. ..... 312/263; 312/334.28; 312/348.1
(58) Field of Search ..... 312/330.1, 348.1, 312/348.2, 348.4, 334.29, 334.46, 257.1, 263

(56) References Cited

U.S. PATENT DOCUMENTS

| | | | | |
|---|---|---|---|---|
| 3,029,357 A | | 4/1962 | Williams | |
| 3,549,301 A | | 12/1970 | Harris et al. | |
| 3,729,246 A | | 4/1973 | Harrell et al. | |
| 5,197,791 A | | 3/1993 | Domenig | |
| 5,261,737 A | * | 11/1993 | Faust et al. | 312/334.46 |
| 5,364,181 A | * | 11/1994 | Scheible | 312/348.4 |
| 5,370,454 A | | 12/1994 | Domenig | |
| 5,433,518 A | | 7/1995 | Skov | |
| 5,460,443 A | * | 10/1995 | Ferrari et al. | 312/348.4 |
| 5,709,443 A | * | 1/1998 | Lautenschlager | 312/334.46 X |
| 5,992,958 A | * | 11/1999 | Scheible | 312/348.2 |

FOREIGN PATENT DOCUMENTS

| | | | |
|---|---|---|---|
| DE | 73 17 344.1 | 5/1973 | |
| DE | 79 00 396 | 6/1980 | |
| DE | 83 33 251.0 | 3/1984 | |
| DE | WO 90/11033 | * 10/1990 | 312/334.46 X |
| DE | 40 16 452 A1 | 9/1991 | |
| DE | 93 11 493.1 | 11/1993 | |
| DE | 94 07 813.0 | 9/1994 | |
| DE | 19726466 A1 | 12/1998 | |

* cited by examiner

*Primary Examiner*—John G. Weiss
*Assistant Examiner*—Michael J. Fisher
(74) *Attorney, Agent, or Firm*—Barnes & Thornburg

(57) ABSTRACT

A pull-out slide is used for fastening a drawer sliding bottom on a side wall of a stationary furniture body. The set has a carrying rail which can be connected with a holding part. The holding part can be fixedly connected with a furniture body. In addition, the set includes at least one slide rail which can slide with respect to the carrying rail, and which can be connected with the drawer sliding bottom. The carrying rail can be locked by a releasable locking mechanism on the holding part, in order to restrict movement in the direction of the carrying rail. The locking mechanism can lock the carrying rail onto the holding part, either in a first direction and/or a second direction, each direction being perpendicular to the carrying rail. Unlocking of the locking mechanism permits removal of the carrying rail and drawer sliding bottom as a unit from the holding part. The pull-out slide set with the sliding bottom is easily and rapidly mounted and demounted.

14 Claims, 13 Drawing Sheets

PULL-OUT SLIDE SET

BACKGROUND AND SUMMARY OF THE INVENTION

The invention relates to a pull-out side set used for fastening a drawer or sliding bottom on a side wall of a stationary furniture body.

Filed contemporaneously herewith are six United States patent applications, commonly assigned to Paul Hettich GmbH & Co.:

| INVENTOR(S) | TITLE | ATTY DOCKET |
|---|---|---|
| Müterthies, Rüter, et al. | Fastening Arrangement | 824/36770 |
| Müterthies, Rüter, et al. | Fastening Arrangement | 824/36771 |
| Müterthies, Rüter, et al. | Mounting Unit | 824/36772 |
| Müterthies, Rüter, et al. | Fastening Arrangement | 824/36773 |
| Müterthies, Rüter, et al. | Partitioning System | 824/36775 |
| Müterthies, Rüter, et al. | Fastening Arrangement | 824/36785 |

The claims, drawings and specification of each of the foregoing applications is hereby specifically incorporated by reference into this specification as if set forth verbatim herein.

During the life of a piece of furniture having a pull-out slide set, it is frequently necessary to disassemble the piece of furniture into individual components which are more portable, and to reassemble the components at a different site. When a piece of furniture has several drawers, it is expedient for the disassembly to take place as effectively as possible without affecting the stability of the reassembled piece of furniture.

German Patent Document DE 83 33 251 U1 shows a pull-out slide set for drawers wherein the drawer can be hung into the pull-out rails of the pull-out slide set mounted in the furniture body and can be removed again. In order to facilitate the installation and removal of the drawer, a locking device is provided on each pull-out slide set to hold the pull-out rail on the carrying rail. The carrying rail is screwed to the furniture body, while the pull-out rail, displaceably carried on the carrying rail, is detachably connected with a drawer. The locking device is disposed on the pull-out rail and can lock downward into a recess in the carrying rail. Thus, the drawer can be removed from the furniture body while the pull-out slide set remains in the furniture body.

This pull-out slide set has disadvantages. For example, the heavy pull-out slide set, which is usually made of sheet metal, remains in the furniture body which, compared with the drawer, is very heavy. The disassembly of the piece of furniture into individual components therefore results in an extremely uneven weight distribution of the individual components. Furthermore, the known locking device is not secure because the lock can easily be unintentionally unlocked. When the lock is unintentionally released, the pull-out rail can slide out of the furniture body and injure persons or damage objects. Because the furniture body is unwieldy and heavy, such an unintentional unlocking of the locking device can easily occur during the transport of the furniture body.

The present invention provides a pull-out slide set which is easy to mount, and permits the disassembly of a piece of furniture into only a few individual components with a relatively even weight distribution. In addition, the pull-out slide set protects against faulty operations, and can be manufactured at reasonable cost.

According to the invention, a pull-out slide set for fastening a drawer sliding bottom on a side wall of a stationary furniture body has a carrying rail which can be connected with a holding part fixedly connected with a furniture body and at least one slide rail which is displaceably disposed with respect to the carrying rail and connected with a drawer sliding bottom. The carrying rail has a releasable locking mechanism on the holding part to retain it on the carrying rail. This construction permits a simple mounting and demounting of the pull-out slide set and allows removal of the pull-out slide set while only the holding part remains connected with the furniture body. The weight of a piece of furniture is thus more evenly distributed to the individual components, so that the pull-out slide set present a lower safety risk because of the smaller size and the easier handling.

According to a preferred embodiment of the invention the locking mechanism secures the carrying rail on the holding part in a first direction perpendicular to the carrying rail. This construction ensures a secure hold of the pull-out slide set also in a loading direction. Preferably, the carrying rail can be locked at the holding part using a second lock mounted in an inclined manner with respect to the first lock and perpendicular to the carrying rail. As a result, the drawer sliding bottom is securely held in all possible horizontal and vertical directions.

A locking mechanism is obtained which is easily produced at a reasonable cost if this locking mechanism has a displaceable locking element which engages the holding part. In this case, the locking element has devices for locking the holding part in the two directions mentioned earlier.

When unlocked, each slide rail is held on the carrying rail so that, during the removal of the pull-out slide set from the furniture body, movement of the slide rail or rails is essentially prevented. In this context, a slight movement of the slide rails up to approximately 4 cm is still called "essentially fixed" because a movement in this order is still relatively safe. However, a maximal play of the slide rail(s) of less than 1 cm is desirable.

In another embodiment of the invention, a locking element with a catch device which engages a catch element is mounted on the drawer sliding bottom and the locking element can be moved into a released position by means of the catch element. This construction ensures that the locking element is not accidently deactivated, but can be unlocked only by the intentional operation of a catch element.

The catch element is movable. In a first position, it does not engage the locking element and in a second position, it interlocks with the locking element. In order to ease the mounting of the catch element, it is displaceably received on a guiding part and can be fixed in the first and second position. As a result, the fitter can hear and feel whether the desired position of the catch element has been reached.

An easily producible pull-out slide set can be obtained when the locking element is displaceable on a carrying rail, and a guiding element is mounted on the carrying rail. In this case, the guiding element can be fitted onto and held on the carrying rail by a catch device.

If the above-mentioned locking element has at least two locking tongues which at least partially reach around the holding part in the locked condition, the desired locking can be achieved in several directions. The locking element element is displaceably arranged along a recess formed on the carrying rail in order to guide the locking element.

The invention can be produced at reasonable cost if the carrying rail and the provided slide rails are made of metal and the components of the locking mechanism are made of plastic.

According to the invention, a drawer is also provided which has a sliding bottom which is held on each side by a pull-out slide, device, the drawer including a front panel, side walls and a rear wall. The drawer also has two pull-out slide sets.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
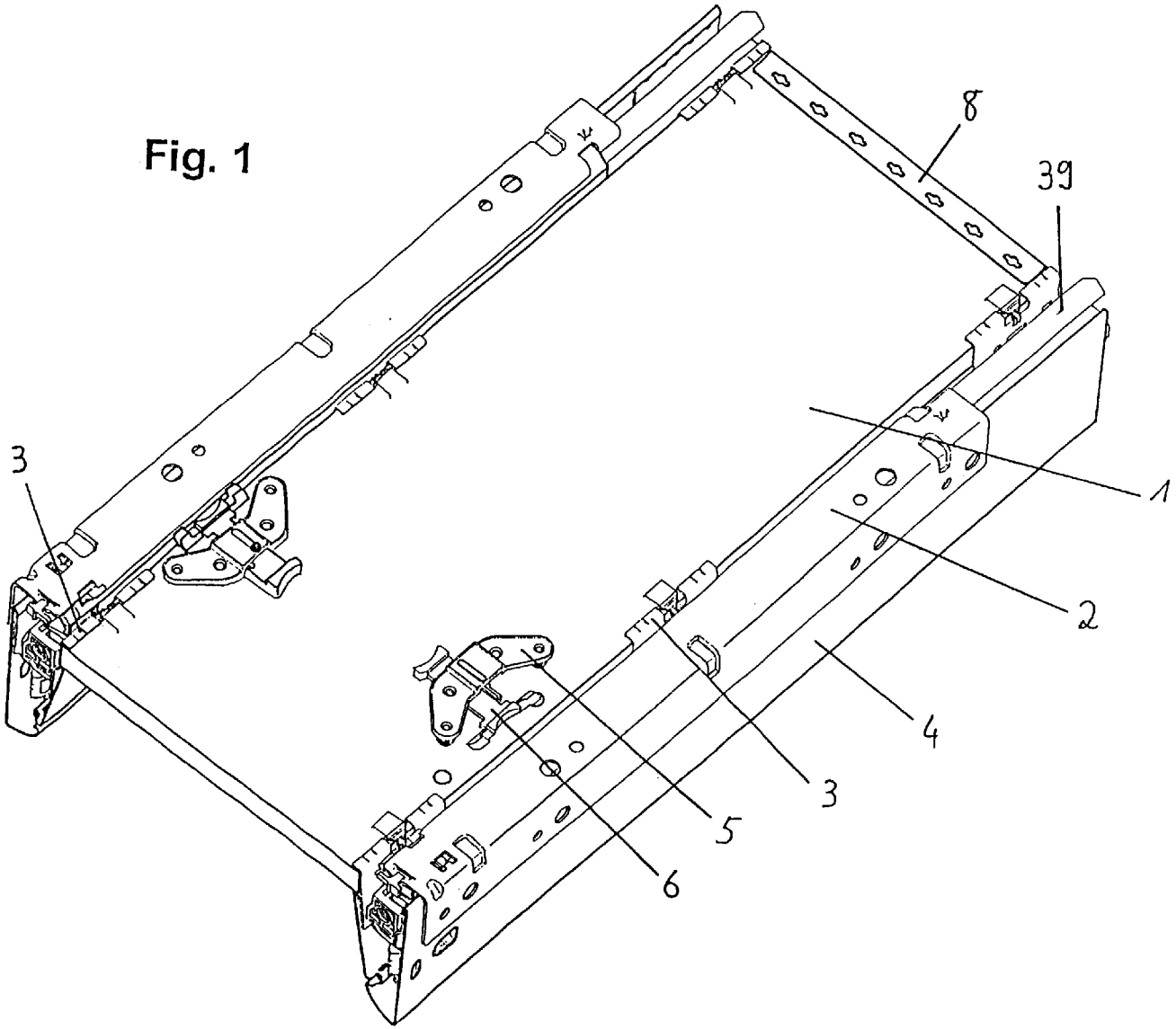
FIG. 1 is a perspective view of a pull-out slide set according to the invention.

The pull-out slide set illustrated in FIG. 1 is used for fastening a sliding bottom 1 of a drawer on a furniture body (not shown) to a drawer slide rail 2. Connection elements 3, which are partially metal, are fastened on each side of the sliding bottom 1 and on a drawer slide rail 40 (see FIG. 10). A carrying rail 9 is connected with a metal holding part 2, which is screwed into a side wall of a furniture body. As shown, two slide rails 39 and 40 are arranged to enable sliding bottom 1 to be pulled beyond the front face of the furniture body. It is also possible to provide only one slide rail 30 for a shorter displacement path.

The sliding bottom 1 is held on both sides by three connection elements 3 respectively which partially reach under the sliding bottom 1. Drawer side wall elements 4 are mounted on the connection elements 3 using catch devices or other holding devices, which rest on the sliding bottom 1 in the direction of the interior side. A rear wall 8 is screwed to the sliding bottom 1, and is locked on both sides with one connection element 3. A front panel 38 is fastened to two forward connection elements 3 (see FIG. 10).

Figure 2:
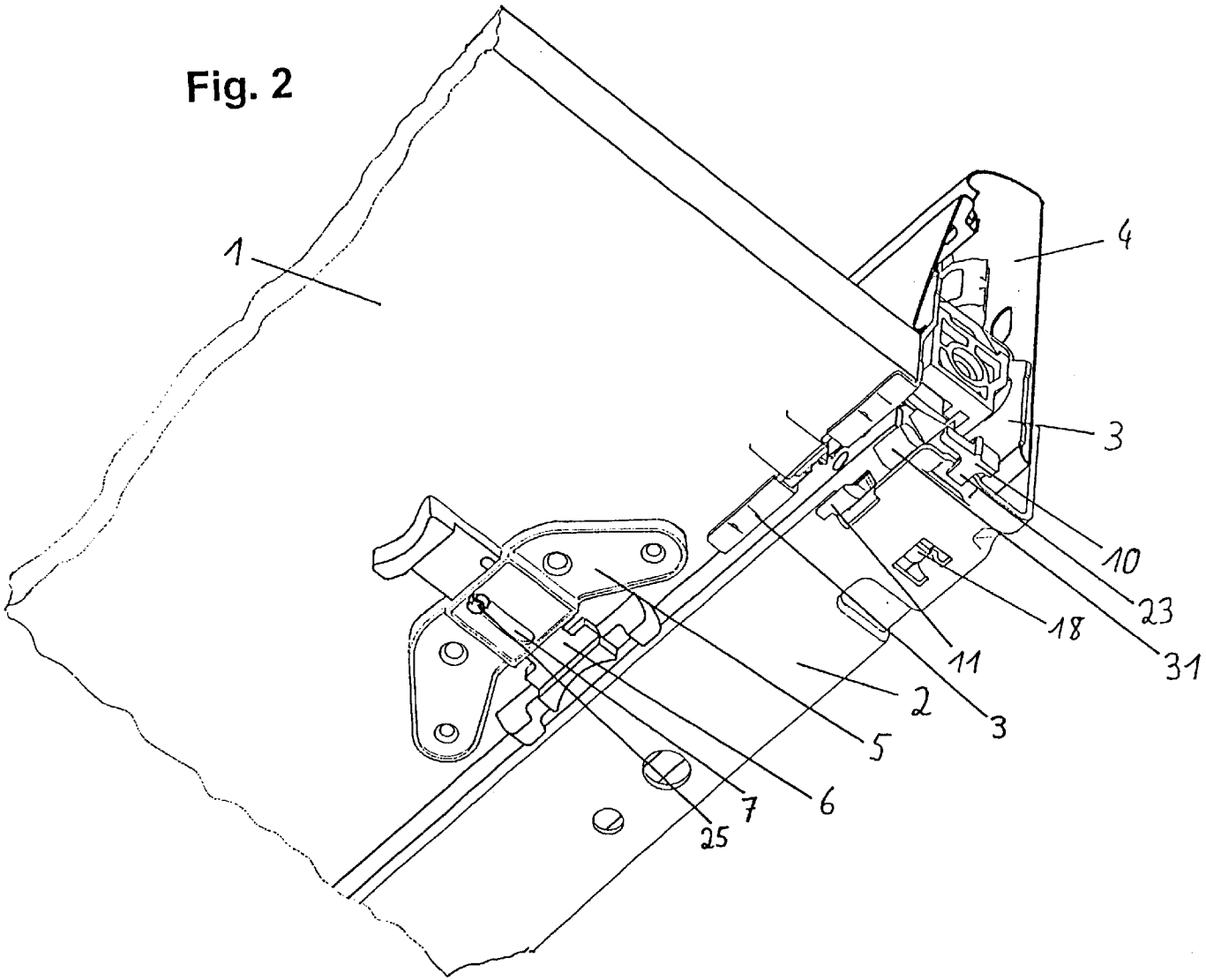
FIG. 2 is an enlarged view of a part of the pull-out slide set as in FIG. 1.

A guiding part 5 is screwed into the underside of sliding bottom 1 and engages a pin provided at two ends into corresponding openings of the sliding bottom 1 (see FIG. 2). The guide part 5 is bent, with a center section bent toward the center of the sliding bottom 1. A mounting of the center section which is directed toward the outside is not possible because otherwise the center section would strike against the holding part 2. A slot 7 is provided in the guide part 5 and guiding head 25 of a catch element 6 is accommodated in the slot 7.

Figure 5:
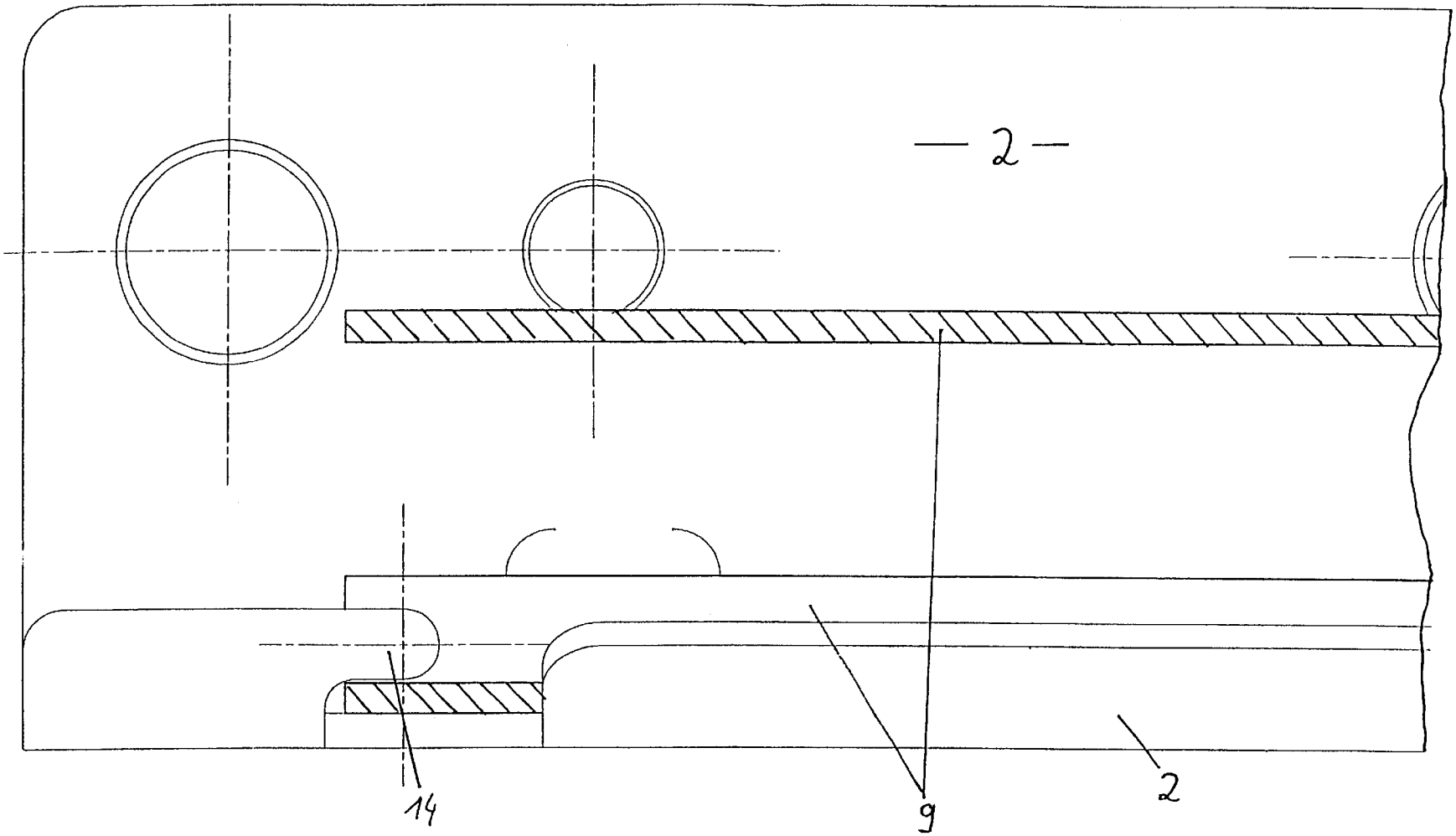
FIG. 5 is a sectional view of the back of the pull-out slide set according to FIG. 1.
Figure 6A:
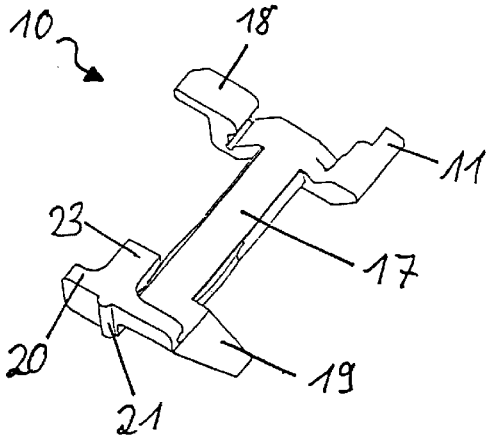
FIGS. 6A to 6D are several views of the locking element of the pull-out slide set.
Figure 6B:
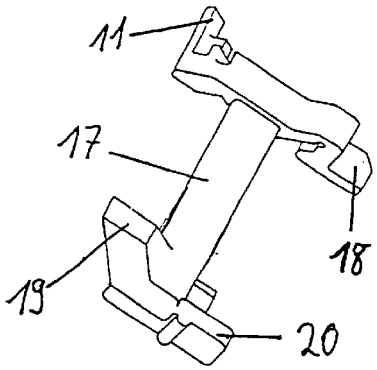
Figure 6C:
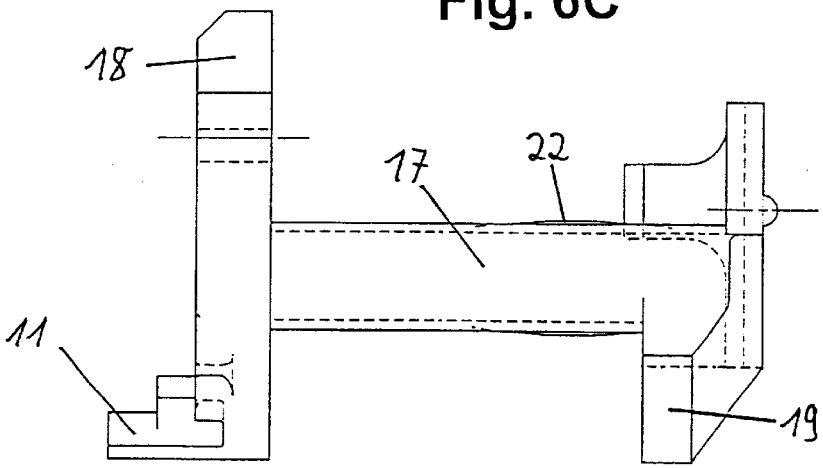
Figure 6D:
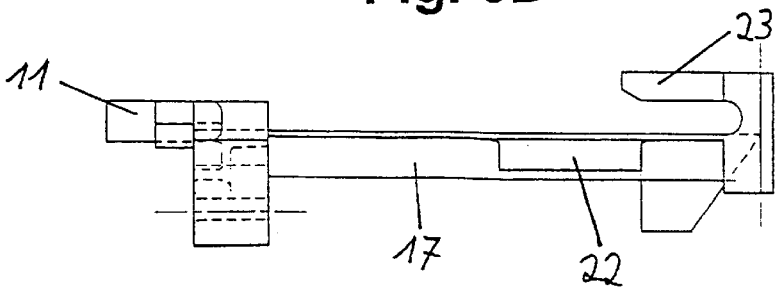
Figure 7A:
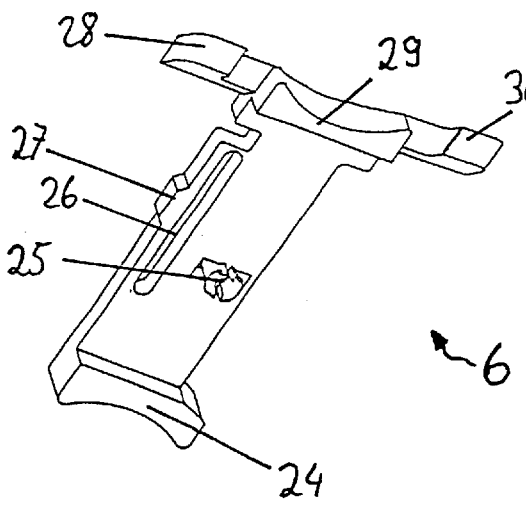
FIGS. 7A to 7E are several views of the catch element of the pull-out slide set.
Figure 7B:
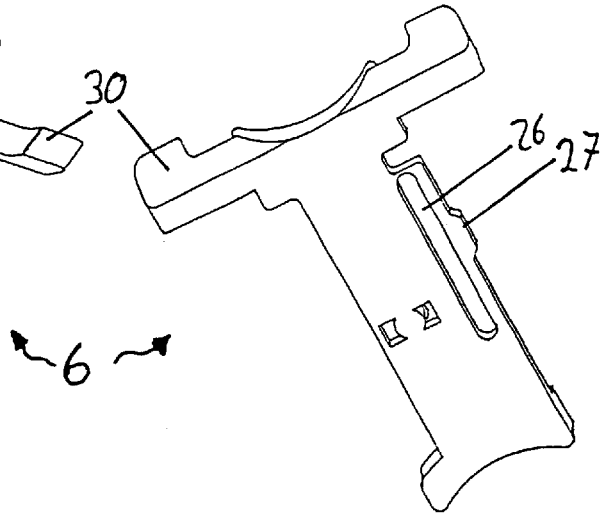
Figure 7C:
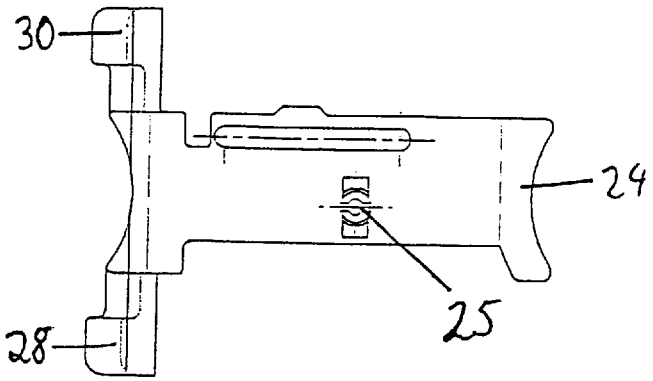
Figure 7E:
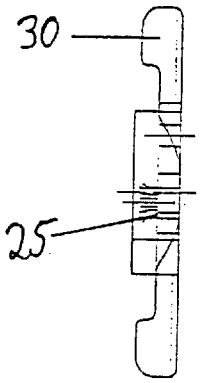
Figure 7D:
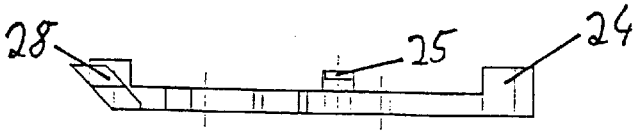
Figure 8A:
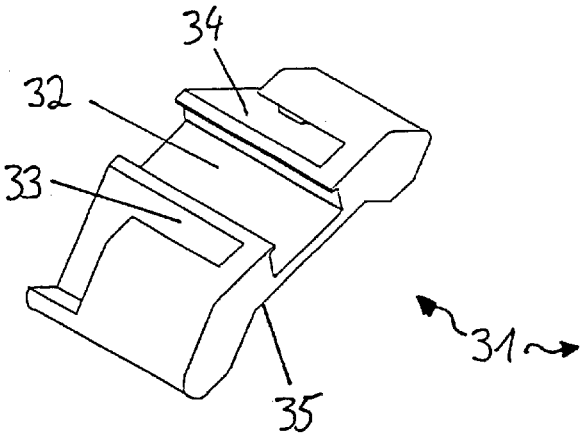
FIGS. 8A to 8D are several views of the guiding element of the pull-out slide set.
Figure 8B:
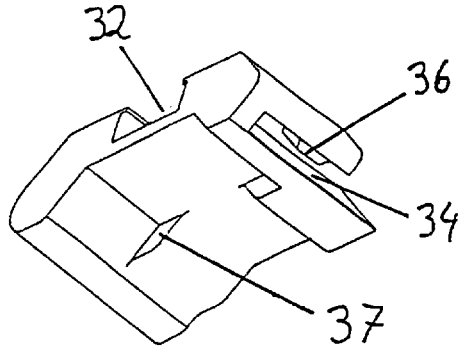
Figure 8C:
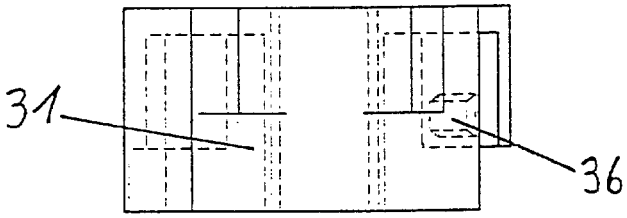
Figure 8D:
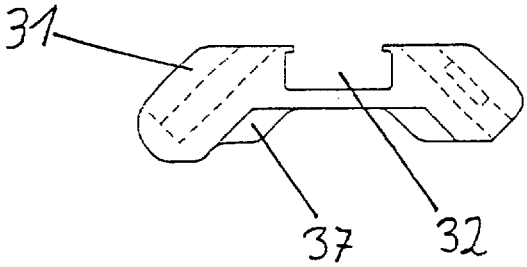

A carrying rail is releasably fastened in the holding part 2. In the rearward part of the holding part 2, a projecting nose 14 is constructed for this purpose, into which nose 14 the rearward end of the carrying rail 9 can slide (FIG. 5). The carrying rail 9 is supported on the bottom of the holding part 2 and the nose 14, in the rearward area in the upward as well as in the downward direction. Indentations and projections are provided on the holding part 2 which guide the carrying rail 9 in the lateral direction in order to slide the carrying rail 9 on the holding part 2 to the correct position. In addition, a stop is shaped into the holding part 2 which limits the slide-in path. The holding part 2 has a diagonally upward bent edge facing the sliding bottom. Another diagonally extending edge of the pentagonal carrying rail 9 rests against the diagonally upward bent edge.

Figure 17:
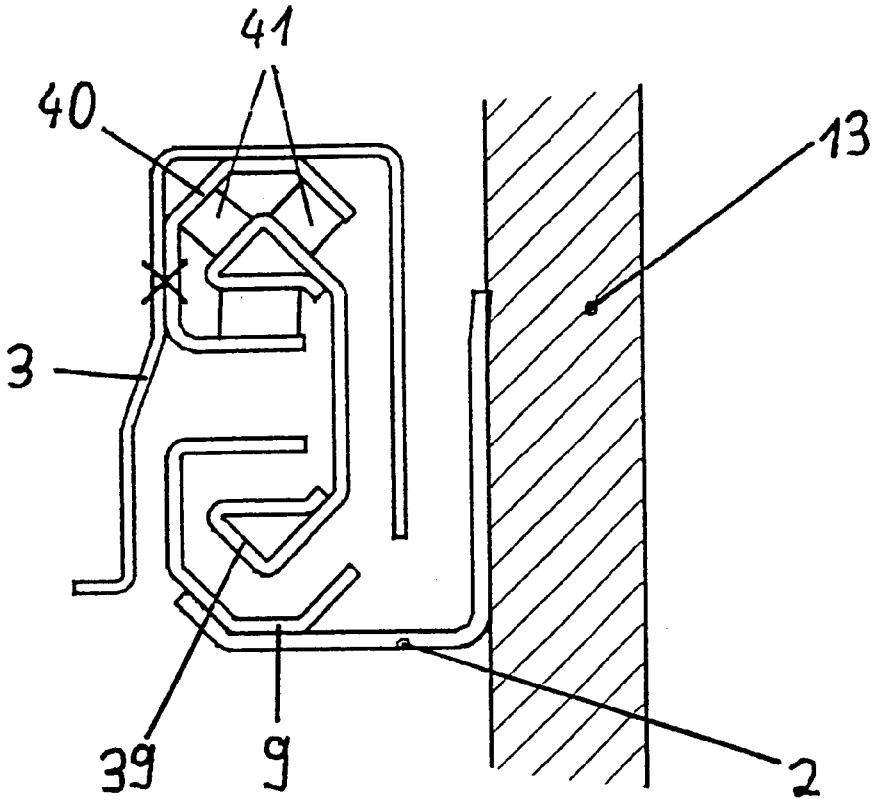
FIG. 17 is a simplified cross-sectional view of the pull-out slide set of FIG. 1.

FIG. 17 is a cross-sectional view of the pull-out slide showing slide rails 39 and 40 and carrying rail 9. Three cylindrical roller bodies 41 are situated between the rails 9, 39, 40 so that the slide rails 39 and 40 are movably guided on the carrying rail 9, and are supported perpendicularly to the moving direction. The bodies are shown between rails 40 and 39 in FIG. 17 and not between rails 39 and 9. On the slide rail 40, the metal section of the connection element 3, is fastened on the side rail 40 at X.

In the forward area of the holding part 2, a locking mechanism secures the carrying rail 9 to the holding part 2 (see FIG. 2). The locking mechanism comprises a locking element 10 movable on the carrying rail 9. A guiding element 31 is fitted onto the carrying rail 9 and forms a guiding channel with the carrying rail 9.

The locking element 10 is illustrated in FIGS. 6A to 6D. A center web 17 connects two end section of the locking element 10. The center web has a widening 22 which interacts with the guiding channel on the guiding element 31 and provides an easy locking, or at least inhibits displacement. The section facing the front side of the sliding bottom 1 has a catch projection 19 with an inclined surface, and is flexibly held at the center web 17. On this side, a holding nose 23 is also situated which is molded to an end section 20 also having a rib-shaped stop 21. A gap is configured between the center web 17 and the holding nose 23 to receive a portion of the end edge of the holding part 2. The bevelled shape of the holding nose 23 guides the edge end into the gap.

On the opposite side of the center web 17, a guiding foot 18 is provided which, in the installed condition, can be displaced along a recess provided in the carrying rail 9, the carrying rail 9 engaging in the approximately V-shaped area of the guiding foot 18. In the locked position of the locking element 10, a projection of the carrying rail 9 engages the outer lower end of the guiding foot 18, which projection supports the locking element 10 (FIG. 2). A locking tongue 11 is molded to the center web 17 and reaches through an opening 15 formed in the carrying rail 9 and, at a recess of the holding part 2, can partially reach around this holding part 2. The locking tongue 11 has a stepped shape because, in the top view, the opening 15 and the recess of the holding part 2 are slightly offset from one another. In this case, the recess and the opening 15 are each constructed at the diagonally upward-extending edge of the holding part 2 or carrying rail 9, so that the locking tongue 11 reaches around the carrying rail 9 and the holding part 2 at the respective edges and locks them in a direction perpendicular to the inclined surface. In contrast, the holding nose 23 is applied to the horizontal curve of an indentation on the holding part 2, so that, as a result of the holding nose, a locking in the vertical direction is ensured.

FIGS. 7A to 7E are several views of the catch element 6. The catch element essentially has a T-shape and, on the bottom of the T, has a downward-projecting grip element 24 which has a lateral projection. By use of the grip element 24, the catch element 6 can be manually displaced in the guide element 5. At a center section of the catch element 6, a guide head 25 is provided which is engaged in the slot 7 of the guide element 5. The guide head 25 and the slot 7 are arranged to be offset with respect to the center axis of the catch element 6, so that the installation of the catch element can take place only in the correctly aligned position. In addition to the guide head 25, a slot 26 and a projection 27 are provided. By means of the slot 26, the projection 27 is elastically held in the lateral direction, so that, during a displacement, the catch element 6 can be locked in two end positions in the guide element 5, a recess for the projection 27 being formed in the guide element 5 for this purpose.

The catch element 6 also has a left catch projection 28 and a right catch projection 30. The two catch projections 28 and 30 have a symmetrical construction, so that the catch element can be used on the right and the left side of the sliding bottom 2. The catch projections 28 and 30 each have catch slopes which, with respect to the shape and the inclination, are constructed such that they can interact with the catch projections 19 on the locking element 10. In addition, a second grip element 29 is constructed at the catch element 6.

FIGS. 8A to 8D are different views of the guide element 31. The guide element 31 has a center guide channel 32, in which the center web 17 of the locking element 10 can be displaceably received. On the guide channel 32, inward-projecting ribs are provided so that, in the mounted condition, there is at least a partial reaching around on all sides on the locking element 10. On both sides of the guide channel 32, receiving devices 33 and 34 are provided in which one end respectively of a diagonally extending edge of the carrying rail 9 can be received. In the receiving device 34, a projection 36 is constructed which can engage in a corresponding recess at the carrying rail 9 in order to lock the guide element 31 on the carrying rail 9. In addition, stops 37 are constructed on the guide element 31 which bound a movement of the catch element 65 during a locking operation described above.

Figure 3:
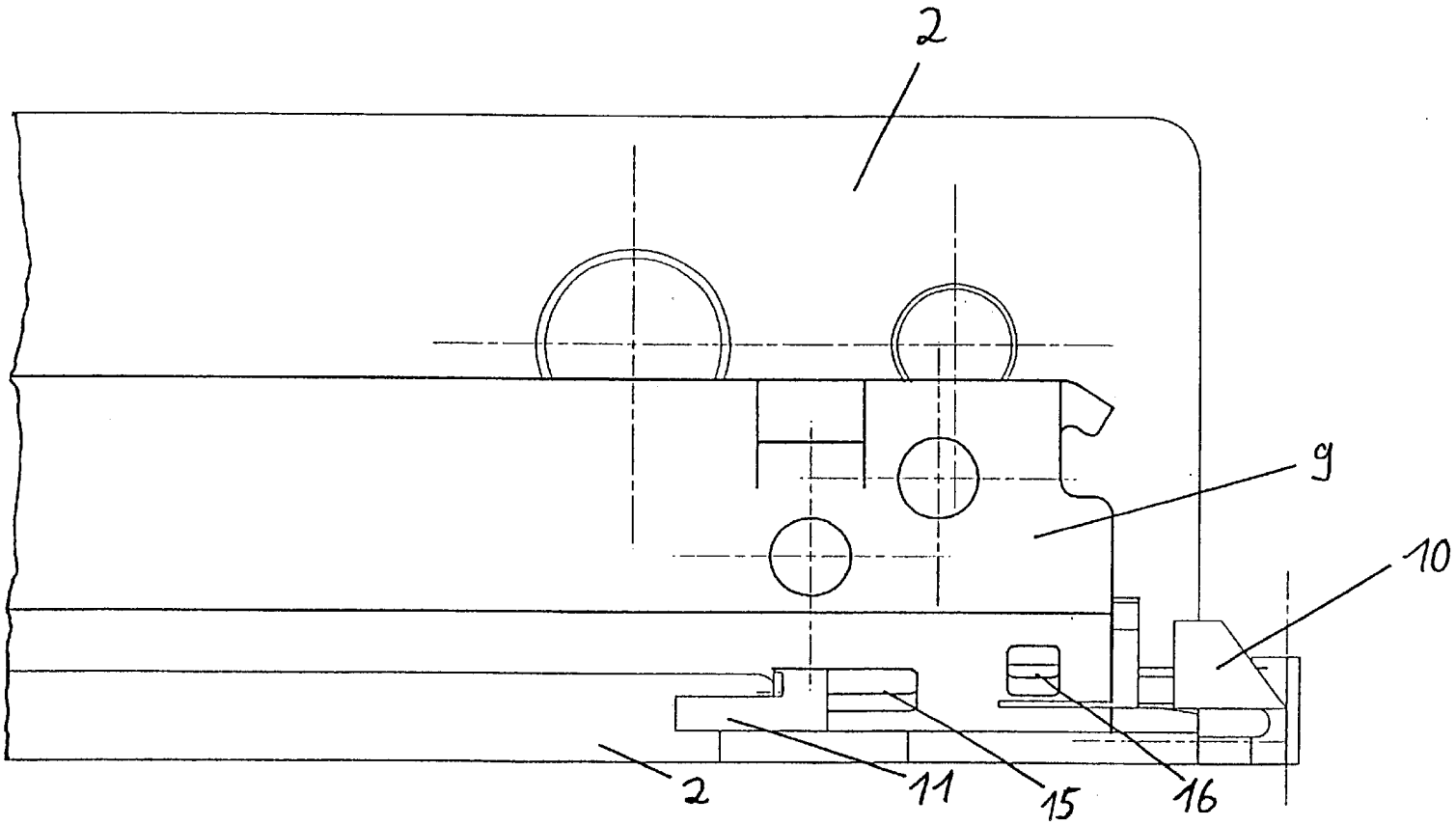
FIG. 3 is a lateral view of the front of the pull-out slide set according to FIG. 1, shown in the locked position.

The locking mechanism will be described in the following. In the position illustrated in FIG. 3, the carrying rail 9 is fixedly locked with the holding part 2. For this purpose, the locking tongue 11 and the holding nose 23 are applied to the exterior side of the holding part 2 and thus clamp the carrying rail 9 against the holding part 2. Because the locking tongue 11 and the holding nose 23 are applied to differently sloped surfaces, the carrying rail 9 is secured perpendicularly to its rail axis in several directions. In the direction of the rail axis, an upward-projecting stop is impressed at the holding part 2 which limits the movement of the carrying rail 9 in the longitudinal direction with minimal play.

Figure 4:
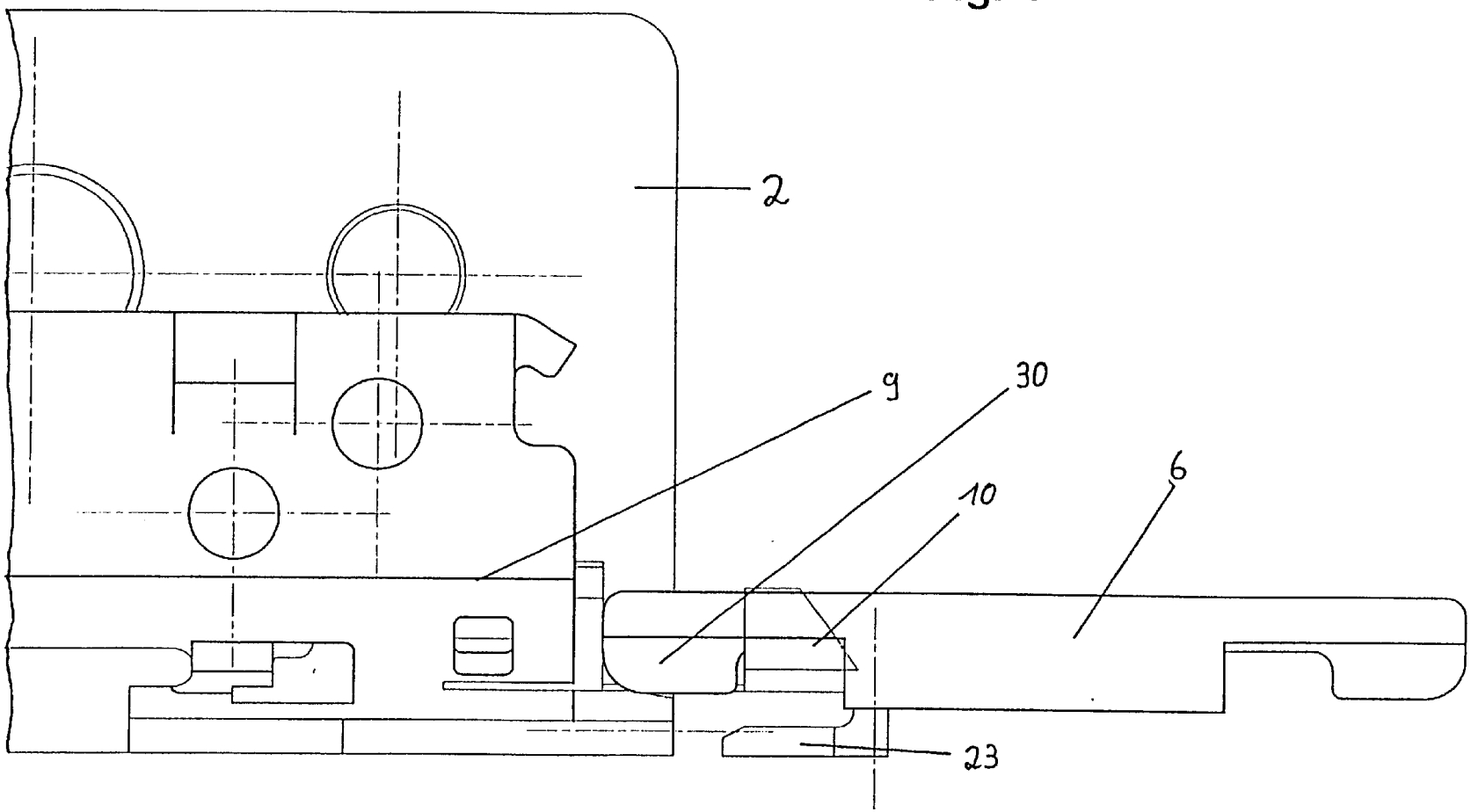
FIG. 4 is a lateral view of the forward part of the pull-out slide set shown in FIG. 1 in the unlocked and locked position.

For opening the locking mechanism, while the drawer is open, the catch element 6 is moved with the catch projections 28 and 30 toward the locking element 10 until an inclined surface of a catch projection 28 or 30, during the subsequent closing of the drawer, slides on the inclined surface of the catch projections 19 along the locking element 10 and, as a result of the elasticity, is pressed away in the upward direction. Subsequently, the catch projection 28 and engages behind the catch projection 19 at the locking element 10. The catch element 6 is now fixedly connected with the locking element 10. In the course of the described engagement, the catch projection 18 or 30 has pulled the locking element 10 by way of the catch projection 19 by an extent toward the outside and thus releases the locking mechanism (FIG. 4). In this position, the holding nose 23 and the locking tongue 11 will no longer reach around the holding part 2, so that the carrying rail 9 can be lifted and can be removed over the stop on the holding part toward the front.

The individual steps for removing and inserting the drawer will be described in greater detail below.

Figure 9:
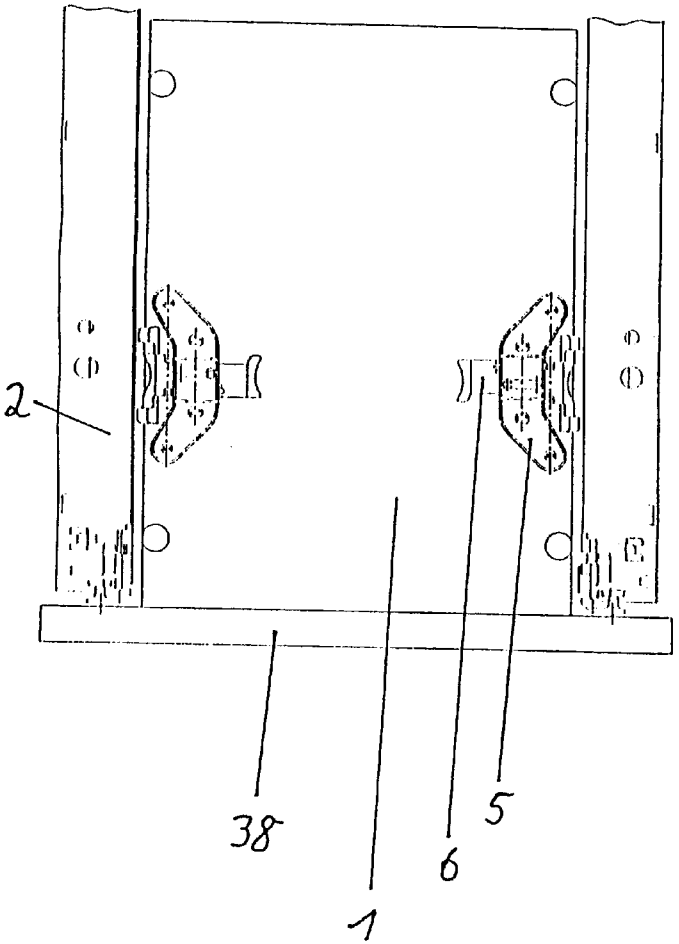
FIG. 9 is a bottom view of the mounted pull-out slide set of FIG. 1, shown with the drawer closed.
Figure 12:
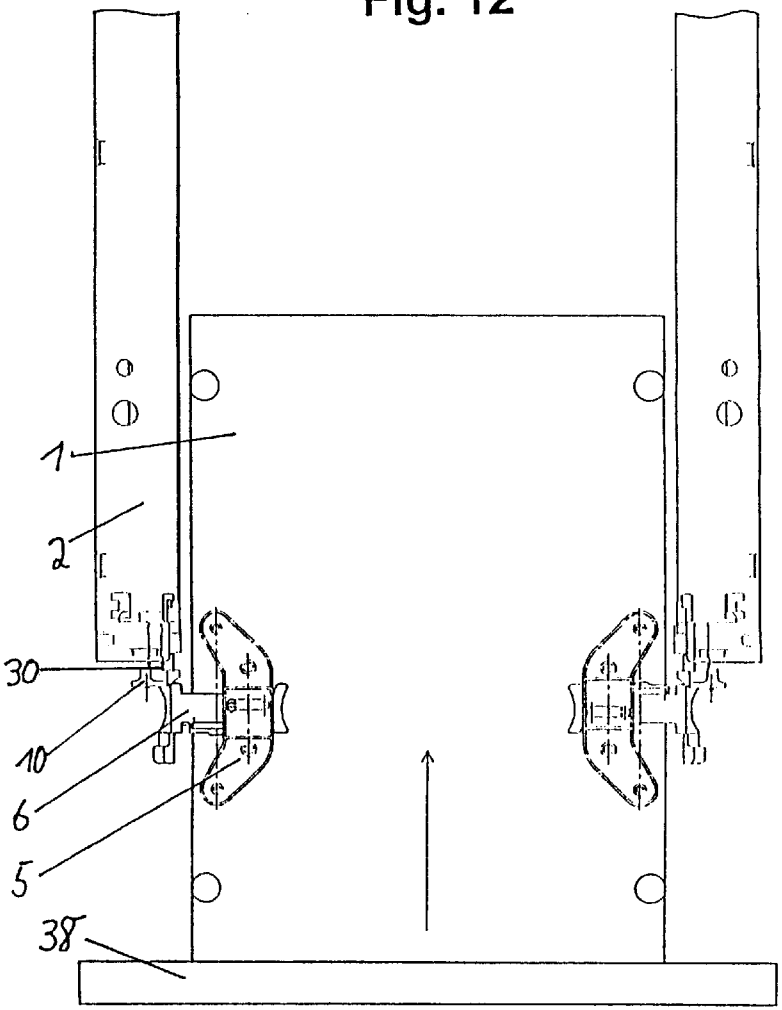
FIG. 12 is a bottom view of the pull-out slide set of FIG. 9 in the removable position.

In the installed condition, the drawer with the sliding bottom 1 is in the position illustrated in FIG. 9. The front panel 38 rests against the stop 21 of the locking element 10 and the catch element 6 is received in the guide element 5 and hangs freely on the underside of the sliding bottom.

Figure 10:
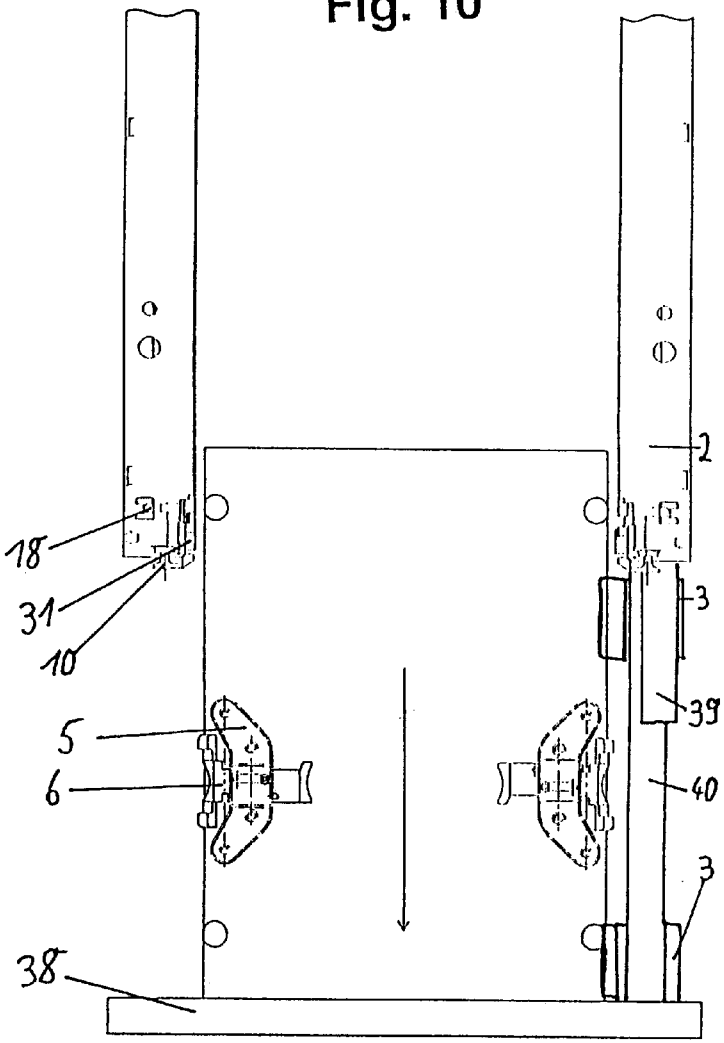
FIG. 10 is a bottom view of the pull-out slide set, shown with the drawer open.

For the removal of the drawer, this drawer is first pulled out of the furniture body not illustrated in FIG. 10. In FIG. 10, the pull-out slide with the slide rails 30 and 40 is schematically illustrated only on the right side. However, the slide rails 39 and 40 are always situated on both sides next to the sliding bottom 1, even if this is not shown in FIGS. 9 to 16 for the purpose of providing clarity.

Figure 11:
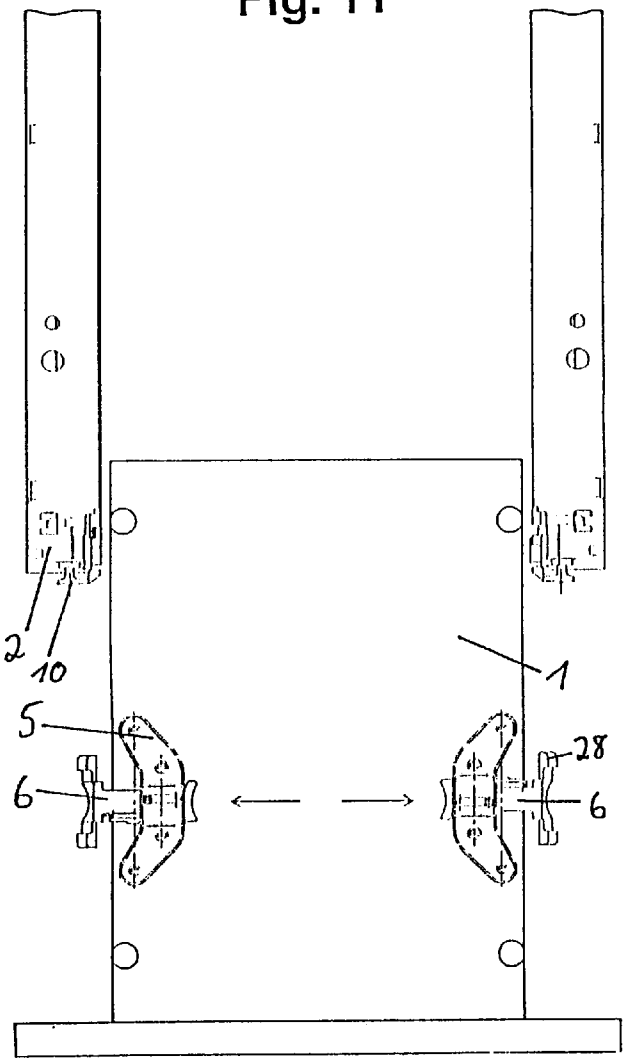
FIG. 11 is a bottom view of the pull-out slide set of FIG. 9 while the catch element is adjusted.

In order to release the locking mechanism, as briefly described above, the two catch elements 6 are displaced toward the outside on the underside of the sliding bottom 1 until they lock in their outer position. The catch projections 28 and 30 are situated in the pull-out direction to the right and left locking element (FIG. 11).

The drawer is then slid in again until the catch projections 28 and 30 each lock by means of a catch projection 19 on a locking element 10 (FIG. 12), in which case a catching sound is generated which is audible to the fitter. In the course of the engagement, the locking element 10 has experienced a displacement in the longitudinal direction and has released the locking between the holding part 2 and the carrying rail 9, so that the carrying rail 9 is no longer locked at the holding part 2 by means of the locking element 10. Then the drawer with the slide rails 39 and 40 is lifted by a small amount and is removed over the stop on the holding part 2 toward the outside.

The slide rails 39 and 40 and the carrying rail 9 are fixed on one another by means of the locking mechanism and cannot be moved with respect to one another. In this case, a friction roller, which is not shown and is disposed on the slide rail 39, stabilizes the fixing which otherwise provides only a uniform movement of the slide rails 39 and 40. When the drawer is removed, the slide rail 39 or 40 may project beyond the rear wall 8 of the drawer toward the rear. In order to avoid this, the length and the position of the slide rails 39 and 40 may be selected such that, in the locked position of the locking mechanism, they end with the rear wall 8 of the drawer.

The inserting of the drawer takes place in a reverse sequence. First, the unit consisting of the drawer and the pull-out slide is inserted and pushed into the furniture body until the carrying rail 9 arrives under the nose 14 and comes to rest against the rearward stop of the holding part 2, while the carrying rail 9 is placed in the front on the holding part and is blocked by the forward stop on the holding part 2 in the pull-out direction.

Figure 14:
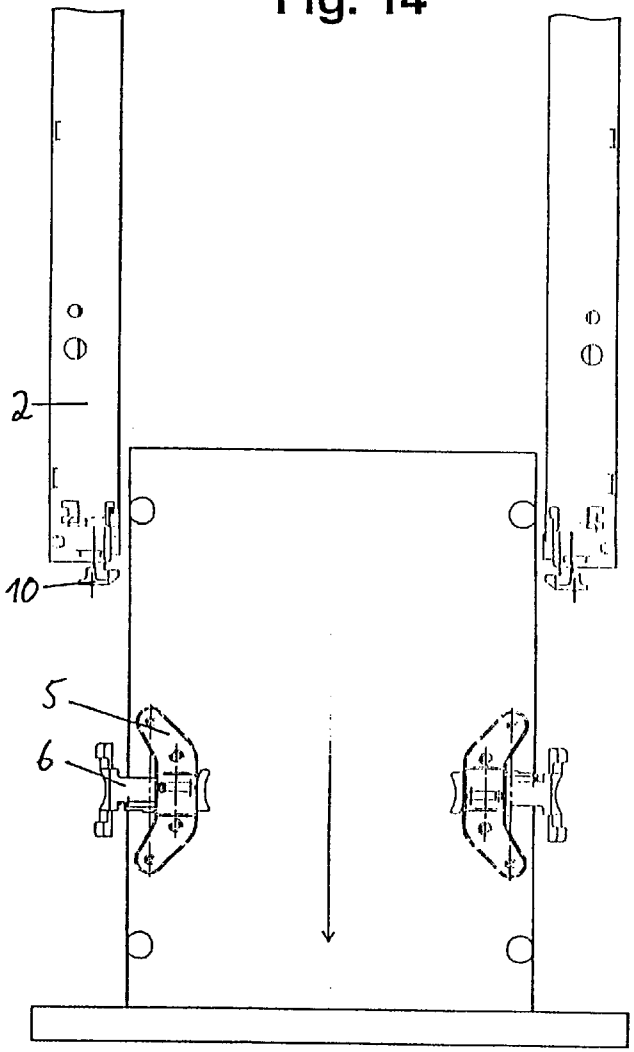
FIG. 14 is a bottom view of the pull-out slide set of FIG. 9 with an unlocked catch device.

The drawer is then forcefully pulled to the outside so that the catch connections between the elastic catch projections 28 and 30 with the respective elastic catch projections 19 of the two locking elements 10 are released (FIG. 14).

Figure 15:
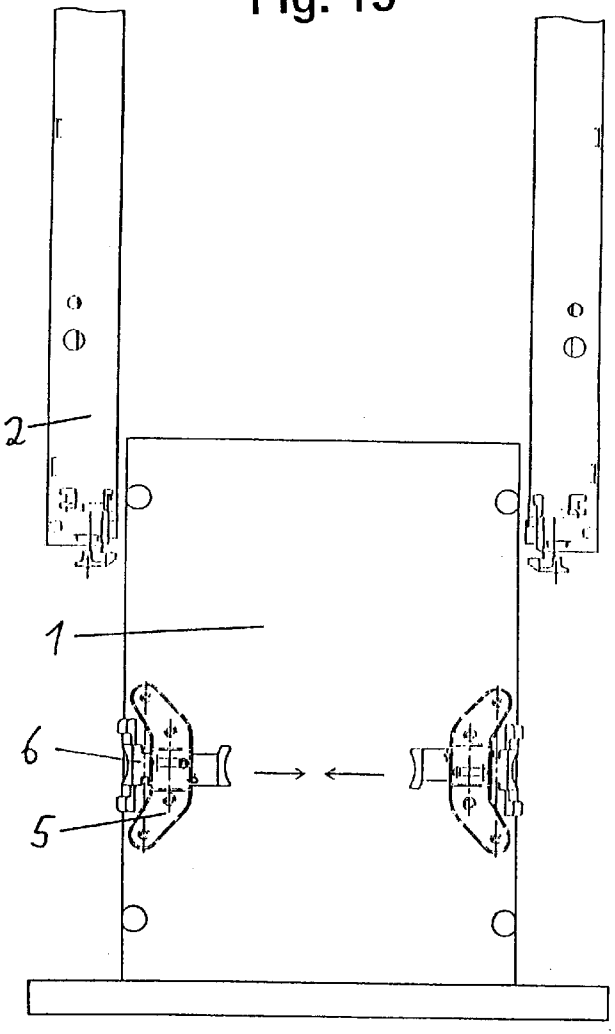
FIG. 15 is a bottom view of the pull-out slide set of FIG. 9 with a pushed-in catch device.

Then the catch elements 6 on both sides of the sliding bottom are displaced toward the interior until they lock in their inner position (FIG. 15).

Figure 16:
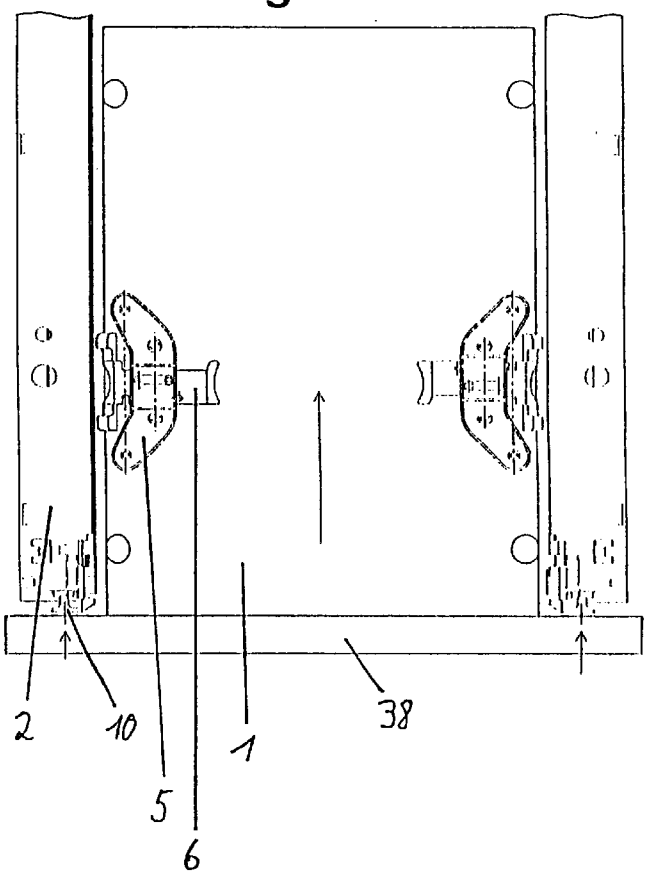
FIG. 16 is a bottom view of the pull-out slide set of FIG. 9 in the unlocked position.

Subsequently, the drawer with the front panel 38 is pushed into the furniture body, the interior side of the front panel 38 abutting against the stops 21 of the two locking elements 10 (FIG. 16). In this case, the locking elements 10 are pressed toward the inside and moved into the locked position, so that the locking tongue 11 and the holding nose 23 reach around the holding part 2 and the carrying rail 9, causing the carrying rail 9 to be fixedly locked on the holding part 2.

Figure 13:
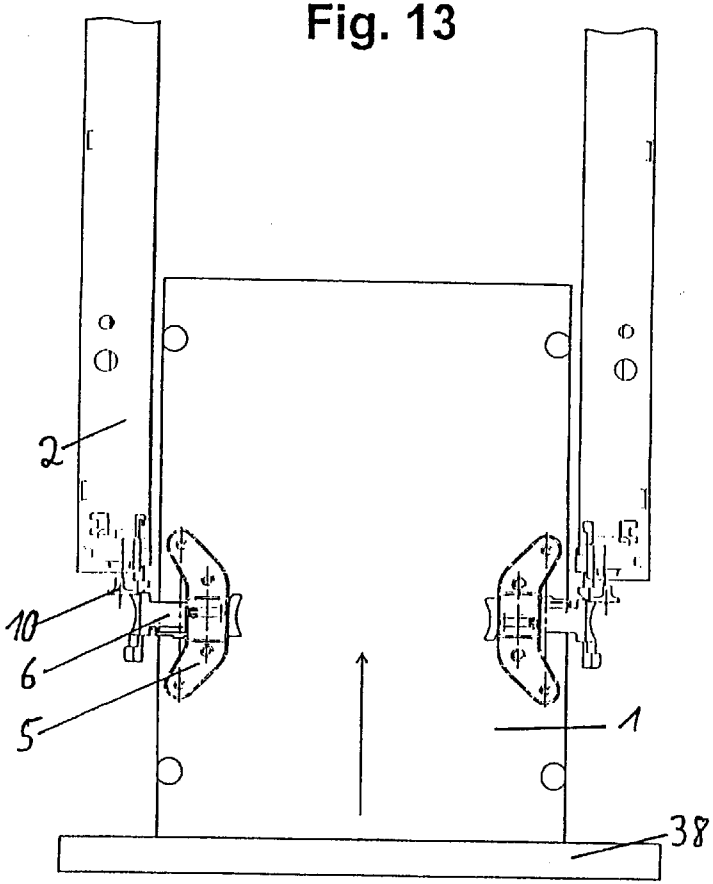
FIG. 13 is a bottom view of the pull-out slide set of FIG. 9 in the inserted position.

As an alternative, in the position illustrated in FIG. 13, the locking mechanism can also be released in that the catch elements 6 are manually displaced toward the center of the drawer. Then the drawer can simply be closed, in which case the front panel 38 abuts against the stops 21 of the two locking elements 10 and, in the process, displaces the locking elements 10 into the locked position.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. A pull-out slide set for fastening a drawer sliding bottom on a side wall of a stationary furniture body, the slide set comprising:

a carrying rail connectable with a holding part;

the holding part connectable with the furniture body;

at least one slide rail movable on the carrying rail and connectable with the sliding bottom; and a releasable lock which in a locked position fixedly connects the carrying rail on the holding part to prevent movement therebetween and in an unlocked position disconnects the carrying rail from the holding part to permit removal of the carrying rail and drawer sliding bottom as a unit from the holding part.

2. A pull-out slide set according to claim 1, wherein the lock is attached to the holding part in a first direction that is perpendicular to the carrying rail.

3. A pull-out slide set according to claim 2, further comprising the lock is attached to the holding part in a second direction perpendicular to the carrying rail and sloped with respect to the first direction.

4. A pull-out slide set according to claim 3, further comprising a displaceable locking element on the releasable lock, and wherein the locking element is configured to engage the holding part.

5. A pull-out slide set according to claim 4, wherein the locking element includes devices to lock the holding part in the first and second direction.

6. A pull-out slide set according to claim 4, further comprising a guide element mounted on the carrying rail; and wherein the locking element is displaceably positioned between the carrying rail and the guide element.

7. A pull-out slide set according to claim 6, wherein the guide element is mounted onto the carrying rail and is held on the carrying rail by a catch device.

8. A pull-out slide set according to claim 4, wherein the locking element has at least two locking tongues which reach at least partially around the holding part in a locked condition.

9. A pull-out slide set according to claim 4, wherein the locking element is displaceably arranged along a recess formed on the carrying rail.

10. A pull-out slide set according to claim 4, wherein the carrying rail and the slide rails are made of metal, and the locking element is plastic.

11. A pull-out slide set according to claim 1, wherein the releasable lock further comprising a locking element with catch device configured to engage a catch element mountable to the drawer sliding bottom, and the locking element can be moved into a released position by the catch element.

12. A pull-out slide set according to claim 11, wherein the catch element is movable between a first position which does not engage the locking element and a second position engaging the locking element.

13. A pull-out slide set according to claim 12, wherein the catch element is displaceably received on a guide part and can be locked in the first and second position.

14. A pull-out slide according to claim 1 in combination with a drawer, having a sliding bottom held at its sides to pull-out slides, and wherein the drawer has a front panel, side walls, a rear wall and two pull-out slide sets.

* * * * *